US005510963A

United States Patent [19]

Bamber et al.

[11] Patent Number: 5,510,963

[45] Date of Patent: Apr. 23, 1996

[54] ATTACHABLE FLASHLIGHT

[75] Inventors: David Bamber; Robert Deines, both of Wichita, Kans.

[73] Assignee: The Coleman Company, Inc., Wichita, Kans.

[21] Appl. No.: 427,005

[22] Filed: Apr. 24, 1995

Related U.S. Application Data

[63] Continuation of Ser. No. 988,803, Dec. 21, 1992.

[51] Int. Cl.[6] ..... F21L 7/00

[52] U.S. Cl. ..... 362/190; 362/202; 362/389; 362/396; 362/399

[58] Field of Search ..... 362/190, 191, 362/200, 202, 205, 208, 389, 396, 399, 400

[56] References Cited

U.S. PATENT DOCUMENTS

| | | | |
|---|---|---|---|
| D. 296,827 | 7/1988 | Yuen | D26/44 |
| D. 328,144 | 7/1992 | Yuen | D26/44 |
| 1,350,837 | 8/1920 | Rampp | 362/191 |
| 1,826,864 | 10/1931 | Buchholz | 362/191 |
| 2,386,255 | 10/1945 | Morey | 362/190 |
| 2,588,772 | 3/1952 | Sill | 362/190 |
| 2,942,102 | 6/1960 | Stoutenburgh | 362/190 |
| 3,005,193 | 10/1961 | Knapp et al. | 362/190 |
| 4,438,483 | 3/1984 | Gulliksen et al. | 362/191 |
| 4,598,340 | 7/1986 | Dwosh et al. | 362/98 |
| 5,019,951 | 5/1991 | Osterhout et al. | 362/191 |

FOREIGN PATENT DOCUMENTS

| | | |
|---|---|---|
| 42071 | 2/1982 | Taiwan . |
| 55650 | 1/1984 | Taiwan . |
| 131706 | 3/1990 | Taiwan . |

OTHER PUBLICATIONS

China Electric Mfg. Corporation's 1989 catalog, p. 97, item No. HL–007.

*Primary Examiner*—Ira S. Lazarus
*Assistant Examiner*—Alan B. Cariaso
*Attorney, Agent, or Firm*—Tilton, Fallon, Lungmus & Chestnut

[57] ABSTRACT

An attachable flashlight includes a housing for containing a power source and a light source. The housing has an elongate opening, a generally round opening and a hook disposed on one of its sides for allowing a user to releasably secure the flashlight to a support.

6 Claims, 1 Drawing Sheet

ATTACHABLE FLASHLIGHT

This application is a continuation of application Ser. No. 07/988,803, filed Dec. 21, 1992.

BACKGROUND OF THE INVENTION

The present invention relates to an attachable flashlight, and more particularly to a flashlight which includes means for quickly and effectively securing the flashlight with a belt, Velcro strap, or lanyard strap.

Flashlights are typically bulky items which cannot easily fit into a person's pocket. Thus, they present a problem to those who have to use them for extended periods of time. Accordingly, a flashlight should include securing means disposed in one location where the means allow a user to easily secure the flashlight to his or her body with a variety of straps and fasteners.

The attachable flashlight of the present invention does just that. It allows the user to releasably secure it to his or her body. This flashlight provides a simple and compact construction which minimizes the expense of manufacture and assembly and provides reliable performance.

SUMMARY OF THE INVENTION

In accordance with one embodiment of the present invention, an attachable flashlight includes a housing for containing a power source and a light source. The housing comprises securing means disposed at one side of the housing and including a hook segment. The securing means also includes an elongate opening and a generally round opening which the housing defines. A user may use the hook to hang the flashlight from a belt, or the elongate opening to pass a Velcro or similar strap through the housing, or the generally round opening to pass a lanyard strap through the housing.

BRIEF DESCRIPTION OF THE DRAWINGS

For a more complete understanding of this invention one should now refer to the embodiment illustrated in greater detail in the accompanying drawings and described below by way of an example of the invention. In the drawings.

While the following disclosure describes the invention in connection with one embodiment one should understand that the invention is not limited to this embodiment. Furthermore, one should understand that the drawings are not to scale and that graphic symbols, diagrammatic representations, and fragmentary views, in part, illustrate the embodiment. In certain instances, the disclosure may not include details which are not necessary for an understanding of the present invention such as conventional details of fabrication and assembly.

DETAILED DESCRIPTION OF THE DRAWINGS AND AN EMBODIMENT

Figure 1:
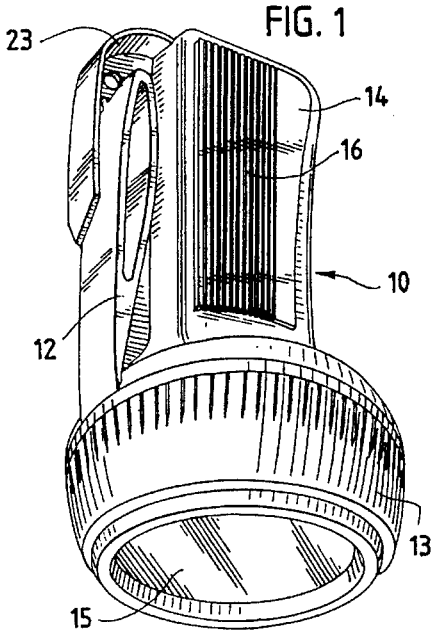
FIG. 1 is a perspective view of the attachable flashlight of the present invention.
Figure 2:
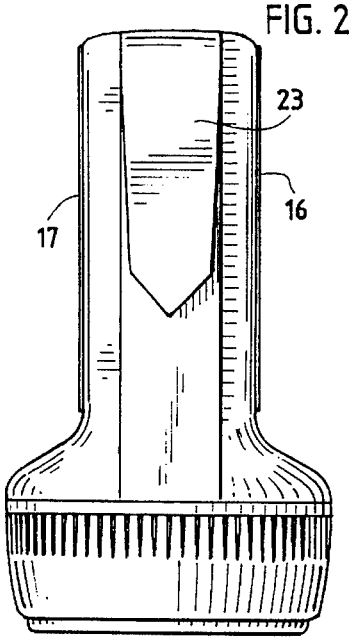
FIG. 2 is a bottom plan view thereof.
Figure 5:
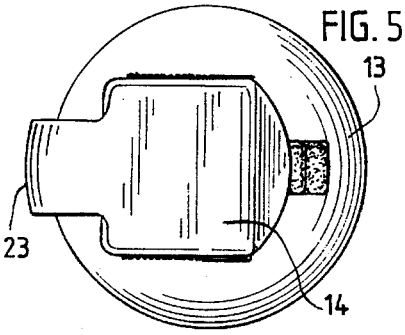
FIG. 5 is a rear view thereof.
Figure 3:
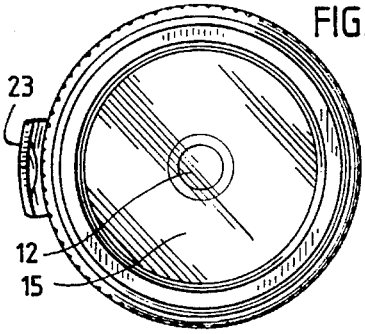
FIG. 3 is a front view thereof.

Referring now to the drawings, one form of the attachable flashlight of the present invention 10 (See FIG. 1) includes a housing 11 made of thermoplastic material of high strength and rigidity. The housing 11 contains a power source (e.g., a battery, not shown) and a light source 12 (See FIG. 3) such as an incandescent bulb.

The housing 11 generally includes a handle portion 13 and a head portion 14 which lies releasably secured to the handle portion with a threaded connection or a similar connection. The head portion 14 includes a window or lens 15 which extends over the light source 12 and through which the light source emits light (See FIGS. 1 and 3).

The handle portion 13 is a one-piece integrally molded unit. It is a flat, elongate portion which defines a plurality of grooves 16 on one side and a plurality of grooves 17 on the other side. These grooves 16 and 17 allow a user to firmly grip and hold the flashlight.

The handle portion 13 defines an opening 18 through which a switch member 19 extends outwardly of the housing. This switch member 19 is part of the flashlight's circuitry (not shown) and allows a user to activate the power source and energize the light source 12.

Figure 7:
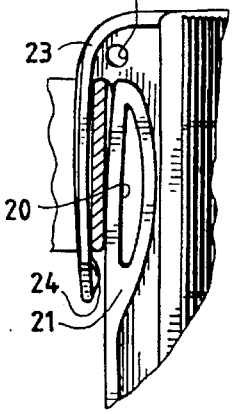
FIG. 7 is a partial side elevation view thereof, showing a belt extending within a hook defined by the housing.
Figure 6:
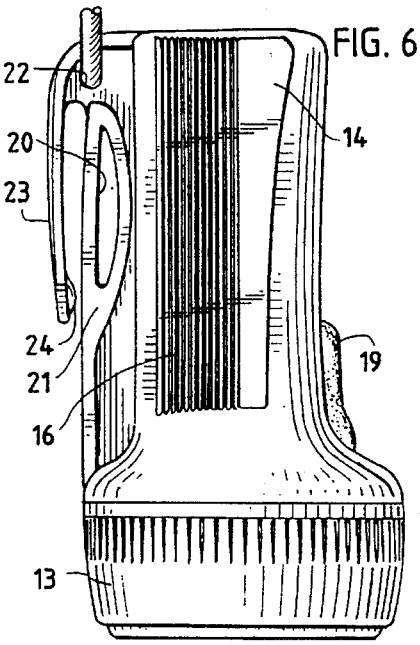
FIG. 6 is a side elevation view thereof, showing a strap extending through an opening in the housing of the flashlight.
Figure 4:
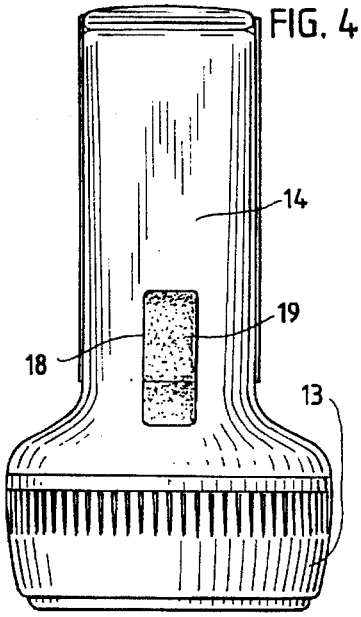
FIG. 4 is a top plan view thereof.
Figure 8:
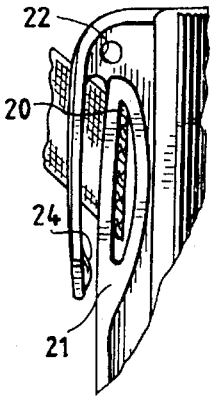
FIG. 8 is a partial side elevation view thereof, showing a Velcro strap extending through an elongate opening in the housing.

The handle portion 13 defines an elongate opening 20 through which one may place a strap (e.g., a Velcro strap) and attach the flashlight to a support (See FIGS. 6–8). The handle portion 13 also defines a loop 21 at one of its sides (i.e., the bottom) to define the opening 20.

The handle portion 13 also includes a generally round opening 22 proximate the elongate opening 20. A user may place a strap such as a lanyard strap through this opening 22 and attach the flashlight to a support.

For securing or hanging the flashlight to a belt, the handle portion 13 includes a hook 23 which lies adjacent the openings 20 and 22, substantially co-extensive with the opening 20. It extends a short, predetermined distance from the loop 21 which defines the elongate opening 20.

This hook 23 is a resilient segment of the thermoplastic handle portion 13 of the housing 11. It bends outwardly of the housing to allow placement of a strap between it and the loop 21; and it returns to the position shown in FIGS. 6–8. It includes a bead 24 at its end to act as a stop and prevent inadvertent removal of the flashlight off the strap.

While the above description and the drawings disclose and illustrate one embodiment, one should understand, of course, that the invention is not limited to this embodiment. Those skilled in the art to which the invention pertains may make modifications and other embodiments employing the principles of this invention, particularly upon considering the foregoing teachings. Therefore, by the appended claims, the applicants intend to cover any modifications and other embodiments as incorporate those features which constitute the essential features of this invention.

What is claimed is:

1. An attachable flashlight comprising; an elongate housing for containing a power source and a light source, said housing including a head portion at a first end of the housing and a handle portion with securing means for releasably securing the flashlight to an article, said securing means including a hook segment which extends generally longitudinally of the housing along a side of the housing from a second end of the housing opposite the first end and defines an elongate slot, said securing means also including an elongate opening, said elongate slot being open at one end of the hook segment and closed at an opposite end of the hook segment proximate the second end of the housing, said elongate slot and opening being disposed generally parallel to one another, said housing including a segment for separating the elongate opening and the slot.

2. the flashlight of claim 1, wherein the elongate opening is substantially co-extensive and lies in general overlapping relation with the hook segment.

3. The flashlight of claim 1, wherein the securing means includes a substantially round opening disposed proximate the elongate opening.

4. The flashlight of claim 1, wherein the handle portion of the housing, including the securing means, is a one piece integrally formed unit.

5. The flashlight of claim 4, wherein the handle portion of the housing defines a plurality of grooves for gripping the flashlight.

6. An attachable flashlight comprising: an elongate housing for containing a power source and a light source, said housing including a head portion at a first end of the housing and a handle portion with securing means for releasably securing the flashlight to an article, said securing means including a hook segment which extends generally from a second end of the housing opposite the first end and defines an elongate slot, said securing means also including an elongate opening and a substantially round opening disposed proximate the elongate opening, said elongate slot being open at one end of the hook segment and closed at an opposite end of the hook segment proximate the second end of the housing, said elongate slot and opening being disposed generally parallel to one another, said housing including a segment for separating the elongate opening and the slot.

* * * * *